US009073120B2

(12) United States Patent
Wietelmann

(10) Patent No.: US 9,073,120 B2
(45) Date of Patent: Jul. 7, 2015

(54) SURFACE-PASSIVATED LITHIUM METAL AND METHOD FOR THE PRODUCTION THEREOF

(75) Inventor: Ulrich Wietelmann, Friedrichsdorf (DE)

(73) Assignee: Chemetall GmbH, Frankfurt am Main ( * ) Notice: Subject to any disclaimer, the term of this patent is extended or adjusted under 35 U.S.C. 154(b) by 420 days.

(21) Appl. No.: 13/515,579

(22) PCT Filed: Nov. 16, 2010

(86) PCT No.: PCT/EP2010/069901

§ 371 (c)(1),
(2), (4) Date: Jan. 29, 2013

(87) PCT Pub. No.: WO2011/073324

PCT Pub. Date: Jun. 23, 2011

(65) Prior Publication Data

US 2013/0122318 A1 May 16, 2013

(30) Foreign Application Priority Data

Dec. 18, 2009 (DE) ..... 10 2009 054 947

(51) Int. Cl.

| | |
|---|---|
| ***C23C 22/48*** | (2006.01) |
| ***C23C 22/03*** | (2006.01) |
| ***B22F 1/00*** | (2006.01) |
| *C23C 22/00* | (2006.01) |
| *B22F 1/02* | (2006.01) |

(52) U.S. Cl.
CPC ..... *B22F 1/02* (2013.01); *B22F 1/0088* (2013.01)

(58) Field of Classification Search
CPC ..... C23C 22/48; C23C 22/58
See application file for complete search history.

(56) References Cited

U.S. PATENT DOCUMENTS

| | | | |
|---|---|---|---|
| 5,567,474 | A | 10/1996 | Dover et al. |
| 5,776,369 | A | 7/1998 | Dover et al. |
| 7,588,623 | B2 | 9/2009 | Dover et al. |
| 2004/0253510 | A1 | 12/2004 | De Jonghe et al. |
| 2008/0283155 | A1 | 11/2008 | Yakovleva et al. |
| 2009/0061321 | A1 | 3/2009 | Yakovleva et al. |
| 2011/0226987 | A1 | 9/2011 | Yakovleva et al. |

FOREIGN PATENT DOCUMENTS

| | | | |
|---|---|---|---|
| WO | WO 2007/005983 | A2 | 1/2007 |
| WO | WO 2008/045557 | A1 | 4/2008 |

*Primary Examiner* — Lois Zheng
(74) *Attorney, Agent, or Firm* — Norton Rose Fulbright US LLP

(57) ABSTRACT

A surface-passivated lithium metal, which has a composite top layer containing or consisting of at least two poorly soluble components containing lithium. Production of the surface-passivated lithium metal such that lithium metal below 180° C., thus in the solid state, is transformed into an inert, aprotic solvent with a passivating agent of the general formula $Li[P(C_2O_4)_{-x/2}F_x]$ where x=0, 2, or 4 is also disclosed.

11 Claims, 3 Drawing Sheets

SURFACE-PASSIVATED LITHIUM METAL AND METHOD FOR THE PRODUCTION THEREOF

Figure 1:
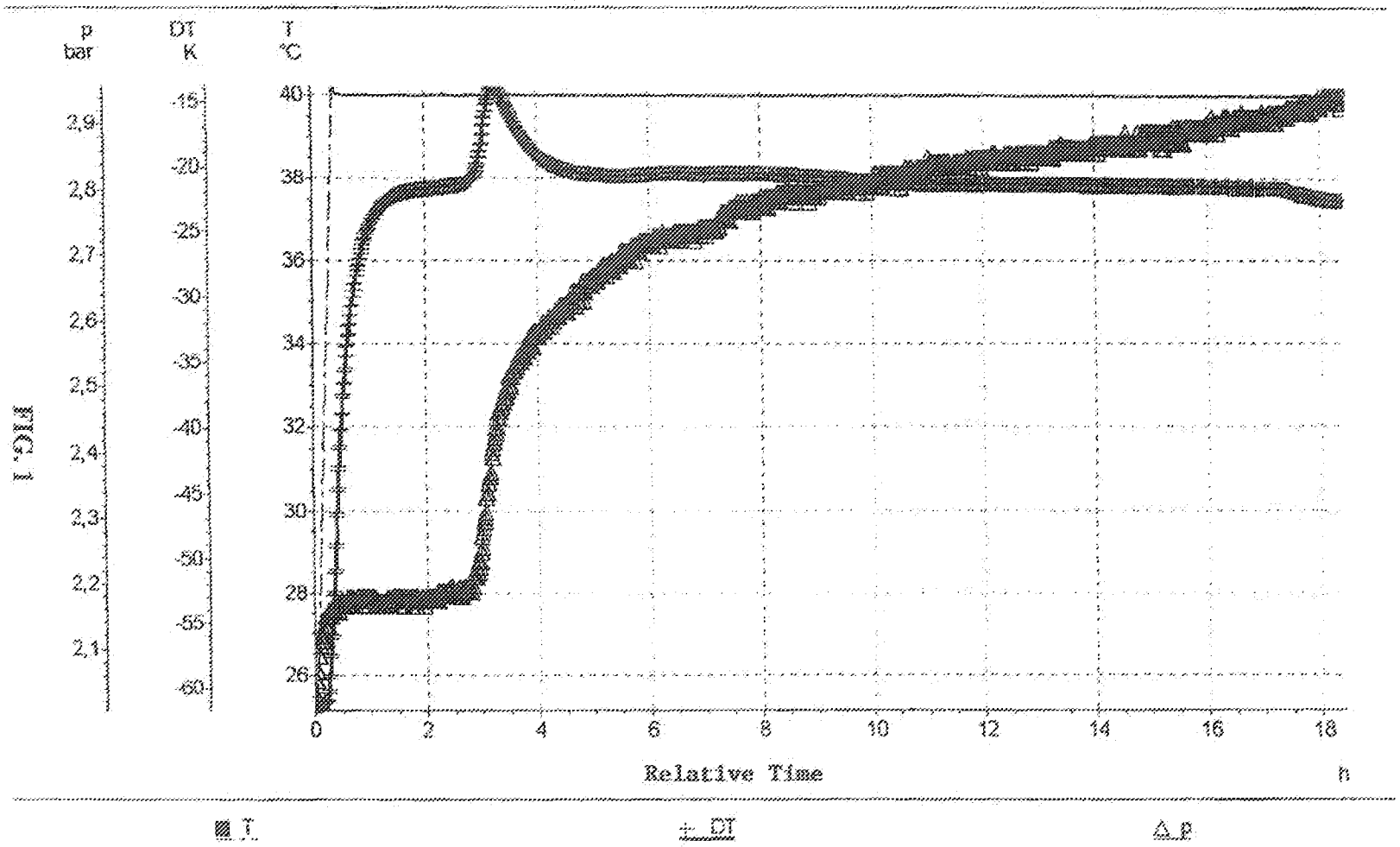

This application is a §371 of PCT/EP2010/069901, filed on Dec. 16, 2010 and claims priority from German Patent Application No. 10 2009 054 947.1, filed on Dec. 18, 2009.

Described is a method for surface passivation of solid lithium metal with a phosphorous passivation agent in an organic solvent.

Lithium belongs to the alkali metals. Like the heavier element homologies, lithium is characterized by a strong reactivity with respect to a variety of substances. It reacts violently, often by igniting, with water, alcohols and other substances which contain protic hydrogen. In air, it is unstable and reacts with oxygen, nitrogen and carbon dioxide. For this reason, it is normally handled in inert gas (noble gases such as argon) and is stored underneath a protective layer of paraffin oil.

Furthermore, it reacts with many functionalized solvents, even if they contain no protic hydrogen. For example, cyclic ether such as THF is opened through ring cleavage, and ester and carbonyl compounds are generally lithiated and reduced. In many cases, the reaction between the mentioned chemicals or environmental substances is catalyzed by water. Thus, lithium metal can be stored and processed in dry air over longer periods of time because it forms a reasonably stable passivation layer which prevents progressing corrosion. The same applies to functionalized solvents, for example, n-methyl-2-pyrrolidone (NMP) which, in anhydrous form, is significantly less reactive toward lithium than, e.g., with a water content >100 ppm.

In order to increase storage life and safety during processing, a number of corrosion-reducing coating methods were developed. For example, it is known from U.S. Pat. No. 5,567,474 and U.S. Pat. No. 5,776,369 to treat molten, finely dissipated lithium metal with $CO_2$. For coating, typically, liquid lithium is brought in contact in inert hydrocarbon with at least 0.3% $CO_2$ for at least 1 minute. However, the protection obtained therewith is not sufficient for many applications, specifically for prelithiation of battery electrode materials in NMP suspension.

Another method for stabilizing lithium metal is to heat it above its melting point, to stir the molten lithium, and to bring it in contact with a fluorinating agent, for example, perfluoropentylamine (WO 2007/005983 A2). The disadvantage is that fluorinating agents are often toxic or corrosive and therefore are used reluctantly in industrial practice.

Another method for protective surface treatment of lithium metal is to coat it with a layer of wax, for example, polyethylene wax (WO 2008/045557 A1). The disadvantage is that for very fine lithium metal powders, relatively large amounts of coating agents are needed. In the examples of the mentioned patent application, approx. 1% is needed.

US 2008/0283155A1 describes a method for stabilizing lithium metal that is characterized by the following steps: a) heating lithium powder to above the melting point to produce molten lithium metal, b) dispersing the molten lithium metal; and c) contacting the molten lithium metal with a phosphor-containing substance to generate a substantially continuous protective layer of lithium phosphate on the lithium powder. The disadvantage of this method is that lithium powder first has to be molten, and coating takes place at temperatures above the melting point of lithium. On the one hand, the relative high temperatures require a correspondingly high energy consumption and, on the other, molten lithium has an extremely corrosive effect on many different materials such as glasses, sealants and many metallic materials such as, for example, carbon-containing steels. Handling the same is therefore an undesirable safety risk, especially on an industrial scale. Furthermore, handling acidically corrosive substances (phosphoric acid), in particular in presence of lithium metal, is disadvantageous because during contacting, the two substances react very violently thereby releasing a significant amount of heat. Moreover, during the transformation of lithium metal with phosphoric acid, explosive hydrogen gas is produced.

Finally, US 2009/0061321 proposes to produce stabilized lithium metal powder with a substantially continuous polymer coating. Said polymer can be selected from, the group consisting of polyurethanes, PTFE, PVC, polystyrene and others. The disadvantage of this method is that the protected lithium metal receives an undefined surface coating of organic substances which can be disturbing when using the lithium metal, for example, for prelithiating electrode materials.

A method for coating lithium metal with a passivating top layer is sought

- which method does not require the use of gaseous or acidically corrosive or toxic passivating agents,
- does not cause the formation of hydrogen gas,
- can be used at temperatures below the melting point of lithium,
- does not result in the formation of undefined organic matters, specifically organic polymers, and
- which effects the formation of a passivated protective layer on the lithium surface.

The object according to the invention is achieved by the features specified in the main claim. Further advantageous configurations are set forth in the sub-claims.

The surface passivated lithium metal has composite top layer containing or consisting of at least two poorly soluble, lithium-containing components.

The surface-passivated lithium metal has a composite top layer containing or consisting of at least two poorly soluble components containing lithium.

Preferably, the composite top layer contains or consists of the poorly soluble components lithium carbonate, lithium fluoride and lithium metaphosphate. Particularly preferred, the composite top layer contains or consists of the poorly soluble components lithium carbonate and lithium metaphosphate. The phosphor content ranges from 0.01 to 2% by mass, preferably 0.03 to 1% by mass of the surface passivated lithium metal.

According to the invention, the production of the surface-passivated lithium metal takes place such that lithium metal below 180° C., thus in the solid state, is transformed in an inert, apriotic solvent with a passivating agent of the general formula $$Li[P(C_2O_4)_{3-x/2}F_x],$$

where x=0.2 or 4.

Preferably, lithium tris(oxalate)phosphate is used as a passivating agent. Said lithium metal is treated in the temperature range between 100 and 175° C. with the passivating agent.

As inert, aprotic solvents, hydrocarbons, ether or mixtures of the mentioned solvent groups are used.

Preferably, aromatic hydrocarbons, preferably toluene, xylene, cumene or tetralin, are used as solvents.

Particularly preferred, the passivating agent is used in dissolved form. Used as a solvent for the passivating agent are ether, preferably THF, THP; ester, preferably ethyl acetate, butyl butyrate; lactone, preferably γ-butyrolactone (GBL), or carbonic acid ester, preferably ethylene carbonate, propylene carbonate, dimethyl carbonate or mixtures of the mentioned solvent. The lithium metal is used as a powder with, a particle size <0.5 mm, as a granulate with a particle size in the range of 0.5 mm to 10 mm, or as a film with a thickness of up to a maximum of 1 mm.

Preferably, the powder has an average particle size (D50) of <200 μm, preferred <100 μm and particularly preferred <50 μm.

The contact time between the passivating agent and the lithium metal is at least 5 minutes, preferably at least 10 minutes.

The passivating agent is used in a molar ratio of 0.2 to 20:1000, preferably 0.5 to 10:1000 based on lithium metal powder, and 0.02 to 1:1000, preferably 0.05 to 0.5:1000 based on granulate or film.

As a passivating agent, a phosphorous substance of the general formula $$Li[P(C_2O_4)_{3-x/2}F_x],$$

where x=0.2 or 4, is used. Preferably, x=0, i.e., the passivating agent is fluorine-free, wherein lithium tris(oxalate)phosphate ("LiTOP") is particularly preferred as a passivating agent.

LiTOP decomposes at temperatures above approx, 140° C. according to the following reaction equation:

$$nLiP(C_2O_4)_3 \rightarrow (LiPO_3)_n + 3nCO_2 + 3nCO$$

The resulting gaseous decomposition products react with lithium metal thereby forming a surface film containing lithium carbonate. It was surprisingly found that the lithium metaphosphate, which is formed at the same time, is also embedded into the surface film so that the formation of a carbonate/metaphosphate mixed phase is to be expected. If the phosphorous passivating agent, is used as a solution in a non-inert, apriotic solvent (for example, a hydrocarbon ester), the protective film may additionally contain degradation products from this solvent. The method according to the invention has the following advantages:

- A composite passivating layer is formed with a single-stage method, whereas according to the prior art, composite top layers can only be produced with multi-stage methods, e.g., first transformation with $CO_2$ gas, then transformation with phosphoric acid.
- Handling of gaseous passivating agents is avoided.
- The passivating active substances are formed through decomposition of the phosphoric (P) passivating agent in the homogenous phase, i.e., all lithium particles are uniformly contacted and coated with the passivating agent.
- No handling of acidic substances.
- By using different solvents which are reactive toward lithium metal, the surface film, can be varied with regard to the proportion of organic matters and their composition, and can be adapted to the different needs.
- Since the operation takes place below the melting point of Li, the form of the lithium metal used is maintained.
- The passivation method operates at comparatively low temperatures.

The surface-passivated lithium metal according to the invention is suitable for chemical lithiation of electrochemically active materials, preferably graphite-, alloy- or conversion-anodes of lithium batteries.

The invention is explained in more detail hereinafter based on three examples, one comparative example and three figures, without limiting therewith the claimed scope.

In the figures:

FIG. 1 shows the thermal behavior of the LiTOP-coated Li powder of Example 1 stored at 40° C.

Figure 2A:
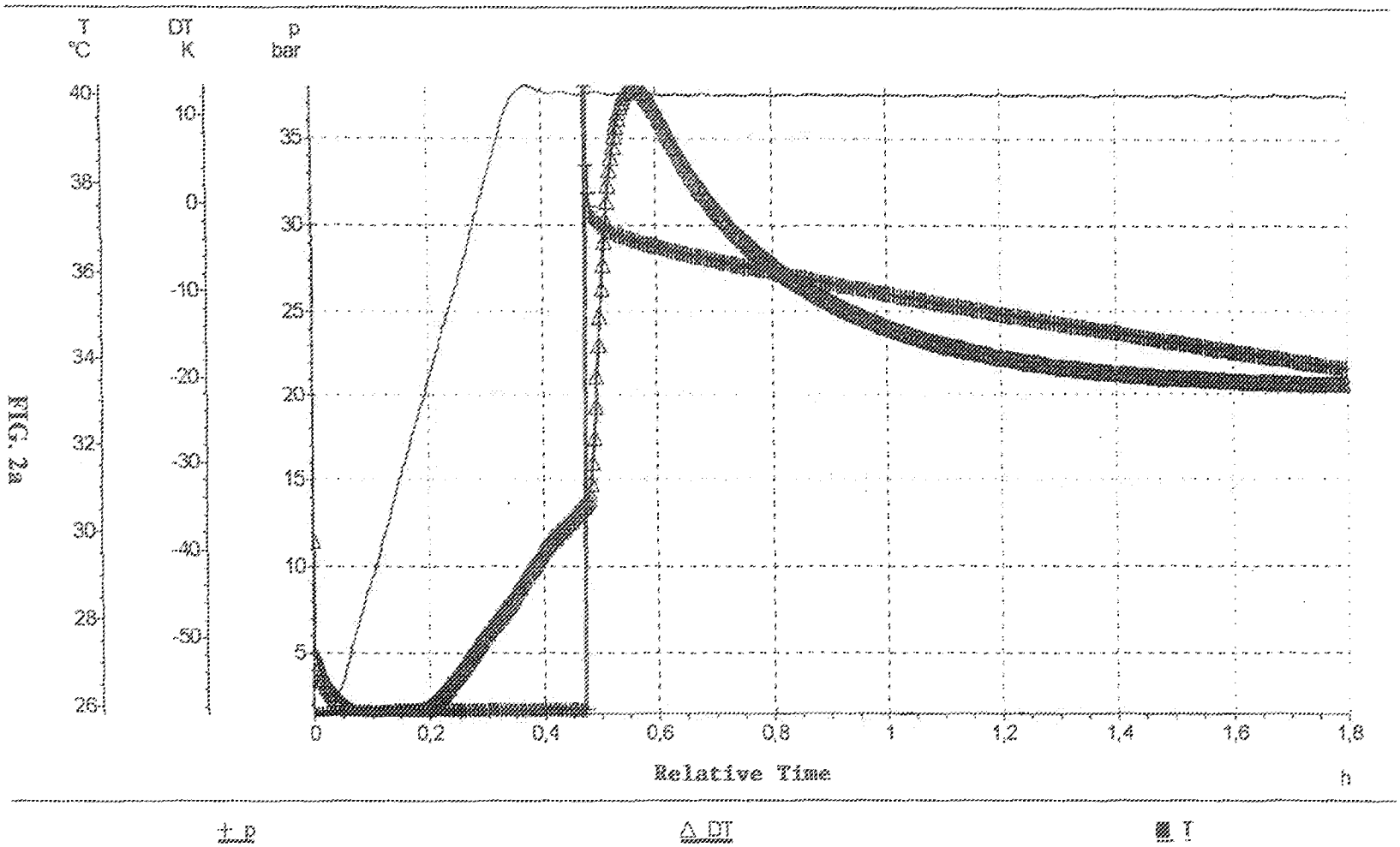

FIG. 2*a* shows the behavior of the uncoated Li powder of the comparative example 4 stored at 40° C. (zoom 2 h)

Figure 2B:
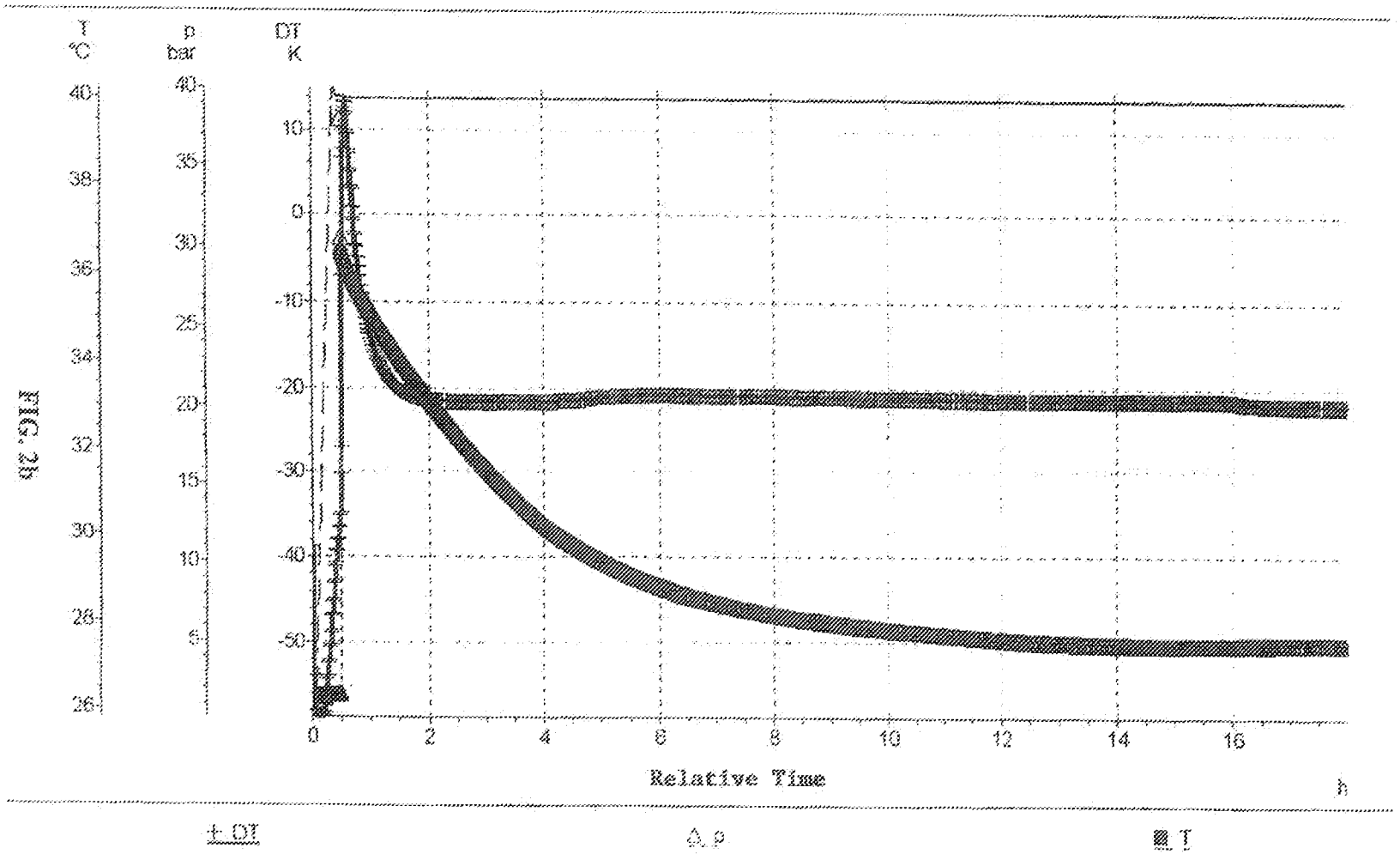

FIG. 2*b* shows the thermal behavior of the uncoated Li powder of the comparative example 4 stored at 40° C. (18 h illustrated)

EXAMPLE 1

Production of LiTOP-Coated Lithium Metal Powder

In an inertized (i.e. heated and filled with argon) 100 ml Schlenk glass flask with return condenser, 5.06 g of lithium dispersion (<50 μm) are added to 17.2 g of cumene and heated by means of an oil bath to reflux (approx. 152° C.) while magnetically stirring. Then, 1.47 g of a 39% by mass solution of LiTOP in propylene carbonate are added by injection (infusion pump) through a septum within 10 minutes. During the addition, slight foaming and gassing can be observed. After the addition is completed, boiling under reflux is continued for another 10 minutes and subsequently, the suspension is cooled to room temperature (RT). The suspension is filtered through a reversible frit, washed with 2×20 ml of cumene and 3×20 ml of hexane and then, vacuum-dried at room temperature for 20 minutes.

Yield: 4.85 g

Content of P: 0.70% by mass

Metal content: 98.5% by mass (measured gas volumetrically)

EXAMPLE 2

Stability of LiTOP-Coated Lithium Metal Powder in NMP 99 mg of the coated lithium powder of Example 1 are weighed in an argon-filled glove box and placed into a 5 ml steel autoclave and are mixed with 2.27 g of 1-methyl-2-pyrrolidone (water content 190 ppm according to Karl Fischer). The container was closed with a cover which is connected to a pressure sensor and heated to a temperature of 40° C. in a special DSC apparatus (Radex, by Systag, Switzerland). As can be seen in FIG. 1, the mixture is stable for a period of slightly more than 2 hours. Only after this time, the beginning of an exothermic reaction can be observed. In the course of this, the pressure increases slightly from 2.2 to approx. 2.8 bar. During the subsequent storing time at a temperature of 40° C., no further thermal events are observed. After cooling down to RT, the steel container was opened and the residual metal content, was determined through hydrolysis with water. The content was 78% by mass.

EXAMPLE 3

Study of Pyrophoric Properties

Coated lithium metal powder, produced as in Example 1, is subjected to the official UN test N.2, the test for pyrophoric properties. In none of the individual experiments, ignition of the powder was observed. Therefore, the powder can be classified as non-pyrophoric.

COMPARATIVE EXAMPLE 1

Stability of Uncoated Lithium Powder in NMP 102 mg of untreated lithium metal powder (<50 μm) were mixed with 2.2 g of NMP (water content 190 ppm), filled into a steel autoclave and, as described in Example 2, subjected to a thermal stability test.

Already a few minutes after reaching 40° C., an explosion-like increase of pressure from 0 to 38 bar was observed, accompanied by an intense exothermic reaction (see FIGS. 2*a* and 2*b*).

After cooling down to RT, the steel container was opened and the residual metal content was determined through hydrolysis with water. The content was 49% by mass.

The invention claimed is:

1. A method for producing a surface-passivated lithium metal comprising the steps of:

transforming a lithium metal in a solid state at a temperature below 180° C. in an inert, aprotic solvent with a passivating agent of the formula $$Li[P(C_2O_4)_{3-x/2}F_x]$$

wherein x=0.2 or 4.

2. The method according to claim 1, wherein the passivating agent is lithium tris(oxalato)phosphate.

3. The method according to claim 1, wherein the lithium metal in the temperature between 100 and 175° C. is treated with the passivating agent.

4. The method according to claim 1, wherein the aprotic solvent is a hydrocarbon.

5. The method according to claim 4, wherein the solvent is selected from the group consisting of toluene, xylene, cumene and tetralin.

6. The method according to claim 4, wherein the passivating agent is dissolved in a solvent.

7. The method according to claim 6, wherein the solvent comprises at least one member selected from the group consisting of an ether, an ester, a lactone and a carbonic acid ester.

8. The method according to claim 1, wherein the lithium metal is a) in powder form having a particle size <0.5 mm, b) a granulate with a particle size in the range of 0.5 mm to 10 mm, or c) a film with a thickness of up to 1 mm.

9. The method according to claim 7, wherein the powder preferably has an average particle size (D50) of <200 μm.

10. The method according to claim 1, wherein a contact time between the passivating agent and the lithium metal is at least 5 minutes.

11. The method according to claim 1, wherein the passivating agent is used in a molar ratio of 0.2 to 20:1000 based on granulate or film.

* * * * *

UNITED STATES PATENT AND TRADEMARK OFFICE

CERTIFICATE OF CORRECTION

PATENT NO. : 9,073,120 B2
APPLICATION NO. : 13/515579
DATED : July 7, 2015
INVENTOR(S) : Ulrich Wietelmann It is certified that error appears in the above-identified patent and that said Letters Patent is hereby corrected as shown below:

ON THE TITLE PAGE

Item (22) replace PCT Filed with the following:

-- Dec. 16, 2010 --.

Signed and Sealed this
Tenth Day of November, 2015

Michelle K. Lee

Michelle K. Lee
*Director of the United States Patent and Trademark Office*